US011913738B2

(12) United States Patent
Delgado Acarreta et al.

(10) Patent No.: US 11,913,738 B2
(45) Date of Patent: Feb. 27, 2024

(54) WEAPON AUTHORIZATION MANAGEMENT SYSTEMS

(71) Applicant: RADE TECNOLOGÍAS S.L, Saragossa (ES)

(72) Inventors: Raúl Delgado Acarreta, Saragossa (ES); Javier Granado Fornás, Saragossa (ES); José Cuesta Álvarez, Saragossa (ES)

(73) Assignee: RADE TECNOLOGÍAS S.L (ES)

( * ) Notice: Subject to any disclaimer, the term of this patent is extended or adjusted under 35 U.S.C. 154(b) by 0 days.

(21) Appl. No.: 17/424,327

(22) PCT Filed: Jan. 21, 2019

(86) PCT No.: PCT/ES2019/070026
§ 371 (c)(1),
(2) Date: Jul. 20, 2021

(87) PCT Pub. No.: WO2020/152374
PCT Pub. Date: Jul. 30, 2020

(65) Prior Publication Data

US 2022/0074691 A1 Mar. 10, 2022

(51) Int. Cl.
*F41A 17/06* (2006.01)
*A43B 3/34* (2022.01)

(52) U.S. Cl.
CPC ..... *F41A 17/063* (2013.01); *A43B 3/34* (2022.01)

(58) Field of Classification Search
CPC ..... F41A 17/063; F41A 17/06; F41A 17/066; A43B 3/34; H04B 13/005
See application file for complete search history.

(56) References Cited

U.S. PATENT DOCUMENTS 4,189,712 A * 2/1980 Lemelson ..... G06K 19/06009 235/382
5,461,812 A * 10/1995 Bennett ..... F41A 17/063 42/70.11
5,603,179 A * 2/1997 Adams ..... F41A 17/066 42/70.11

(Continued)

FOREIGN PATENT DOCUMENTS

EP 2698592 A1 2/2014
WO 2010064162 A1 6/2010

OTHER PUBLICATIONS

International Search Report dated Sep. 12, 2019 re: Application No. PCT/ES2019/070026, pp. 1-3, citing: US 6 861 944 B1, WO 2010/064162 A1 and EP 2 698 592 A1.

(Continued)

*Primary Examiner* — Joshua E Freeman
(74) *Attorney, Agent, or Firm* — SNELL & WILMER LLP

(57) ABSTRACT

An authorization management system for personal use of a weapon includes a receiving module coupled to the weapon and a transmitting module configured to be worn by a user in proximity to a body of the user. The transmitting module is located in proximity to the ground. The transmitting module is configured to transmit a signal representing at least an identification code data associated to the user via a signal path through a user's body. The receiving module is configured to receive the signal and actuate a safety system of the weapon for allowing the user a usage of the weapon based on the received signal.

12 Claims, 4 Drawing Sheets

(56) References Cited

U.S. PATENT DOCUMENTS 5,682,032 A * 10/1997 Philipp ..... G06K 19/07788 235/487
5,828,301 A * 10/1998 Sanchez ..... F41C 33/029 340/568.1
6,678,984 B1 * 1/2004 Rapp ..... F41A 17/066 42/70.11
6,754,472 B1 * 6/2004 Williams ..... H04Q 9/04 455/100
6,861,944 B1 * 3/2005 Hoepelman ..... A43B 3/34 235/382
7,480,492 B2 * 1/2009 Williams ..... H04B 13/005 455/100
8,368,527 B2 * 2/2013 Kano ..... H04B 13/005 340/531
8,625,557 B2 * 1/2014 Fukuda ..... G06F 1/324 370/350
10,365,057 B2 * 7/2019 Black ..... F41A 17/066
10,591,237 B1 * 3/2020 Cannon ..... F41A 17/066
2002/0030585 A1 * 3/2002 Doi ..... H04B 13/005 340/5.64
2004/0056758 A1 * 3/2004 Schwartz ..... G05B 19/0425 340/5.2
2006/0208577 A1 * 9/2006 Richter ..... G07C 9/28 340/5.6
2011/0113664 A1 * 5/2011 Delgado Acarreta ... F41A 17/06 42/70.11
2011/0227856 A1 * 9/2011 Corroy ..... H04B 13/005 345/173
2014/0150316 A1 * 6/2014 Acarreta ..... F41A 17/06 42/70.06
2022/0074691 A1 * 3/2022 Delgado Acarreta .... A43B 3/34

OTHER PUBLICATIONS

Written Opinion dated Sep. 12, 2019 re: Application No. PCT/ES2019/070026, pp. 1-7, citing: US 6 861 944 31, WO 2010/064162 A1 and EP 2 698 592 A1.

* cited by examiner

WEAPON AUTHORIZATION MANAGEMENT SYSTEMS

TECHNICAL FIELD

This disclosure is related to the field of systems for managing permissions for personal use of weapons. More particularly, this disclosure refers to an authorization management system for personal use of weapons and to a weapon and a wearable device implementing the authorization management system.

BACKGROUND

Control systems for controlling the use of weapons are important due to the potential danger of the weapons, especially when they fall into the hands of unauthorized users (e.g., criminals or people with no experience).

Some existing solutions integrate mechanisms to verify the identity of the user handling the weapon. Some of these solutions implement fingerprint identification systems into the weapons. These weapons may integrate a fingerprint scanner that can be used by an authorized user to secure and unlock the weapon. However, this solution has a low recognition speed and may show false negative results. In addition, the use of gloves and the presence of dirt or oils on the fingers or the scanner could hinder the use of these fingerprint identification systems. Other solutions implement identification systems with personal identification numbers (PIN) or alphanumeric passwords. These weapons may incorporate a keyboard or a voice recognition module to introduce the password. Nevertheless, these solutions present a low authorization speed, low security and poor ergonomics. Some other solutions incorporate identification systems integrated into hand bracelets having the electronic to identify the user carrying the bracelet. However, not wearing the hand bracelet disables the weapon even when the user handling the weapon is an authorized user.

Document U.S. Pat. No. 6,861,944 B1 describes an authorization control system for preventing unauthorized use of devices in which the person who is authorized to use the devices wears a transmitter near the person, and more particularly in a finger ring. With the system architecture proposed in such document, the coupling between the return electrode in the firearm and ground is very low. The communication between the transmitter in the finger ring and the receiver in the firearm is quite sensitive to the position of the user's hand relative to the position of the user's body since depending on their relative position the capacities between the firearm and the user significantly change. In addition, the user would need one finger ring in each hand to be able to use the firearm with both hands.

Therefore, there is a need for a system able to provide a reliable and efficient mechanism for preventing unauthorized use of weapons, especially firearms.

SUMMARY

For overcoming the mentioned drawbacks, the present disclosure discloses an authorization management system for personal use of weapons, for example firearms, and a weapon and a wearable device implementing the authorization management system.

The authorization management system for personal use of a weapon may comprise a receiving module attachable to the weapon and a transmitting module that may be configured to be worn by a user in proximity to a body of the user. For example, the transmitting module may be coupled to a wearable device that may be worn by the user. This transmitting module may be located in proximity to the ground, e.g., integrated into a footwear being worn by the user of the weapon. The transmitting module may be configured to capacitively transmit a signal representing at least an identification code data associated to the user via a signal path through the body of the user gripping the weapon. In turn, the receiving module may be configured to receive the signal transmitted by the transmitting module and actuate a safety system of the weapon for allowing the user a usage of the weapon based on the received signal.

By having the transmitting module located in proximity to the physical ground, the magnitude of the signal transmitted from the transmitting module to the receiving module is maximized. This makes the authorization management system more robust against uncoupling due to the relative position of the user's hand gripping the weapon and the user's body. In addition, by maximizing the magnitude of the transmitted signal, the size of the electrodes in the transmitting module and in the receiving module can be reduced. Having small electrodes may be especially useful when the weapon and/or the wearable device in which the receiving module and the transmitting module are respectively integrated are small.

Within the present disclosure, by weapon it is meant any small arm or light weapon, such as a firearm, gun, shotgun, airgun, machine gun, pistol, rifle, revolver, etc. and also non-lethal weapon or archery weapon.

In some examples, the transmitting module may comprise a first electrode electrically coupled to the user's body. The first electrode may be configured to capacitively couple the signal to the user's body via the signal path. The transmitting module may further comprise a second electrode electrically insulated from the user's body and that may be located substantially parallel to the ground. By being the second electrode substantially parallel to the ground the magnitude of the signal capacitively coupled by the first electrode to the user's body is maximized. This second electrode may be electrically insulated from the first electrode and may act as a reference electrode. The transmitting module may comprise a transmitting device located below a calf of the user and being configured to generate the signal and transmit the signal via the first electrode.

In some examples, the transmitting module may be integrated into a footwear, such as any kind of shoes, boots, sandals, indoor footwear, etc. More particularly, the transmitting device may be located in a heel of a footwear or in any other part of the footwear having space enough to house the electronics and wiring associated to the transmitting module. The first electrode may be located within the footwear and in electric contact with the user's body. For example, the first electrode may be located on the upper surface of the insole of the footwear, attached to the footwear insert or may be attached to any other surface of the footwear such as the tongue, the lining, the midsole, etc. In a preferred embodiment, the first electrode may be attached to the footwear insert and located in correspondence to the heel of the footwear. Besides, the second electrode may be coupled to an outsole or a midsole of a footwear. For example, the second electrode may be integrated into the outsole of the footwear or may be attached between the outsole and the midsole of the footwear. The second electrode may be also integrated into the midsole of the footwear.

In some examples, the transmitting device may comprise a first storage unit configured to store at least the identification code data associated to the user. This first storage unit may store the identification code data that unequivocally identify the user wearing the wearable device, such as the footwear, and may further store information received from the receiving module such as the state of the safety system (blocked/unblocked) in the weapon, the number of shots fired by the weapon, etc. The transmitting device may further comprise an encoding unit to encode the signal by modulating an electric field that capacitively couples to the user's body and a first transceiver to transmit the encoded signal via the first electrode. The first transceiver may be used for receiving information from the receiving module or from any other external device. The first transceiver may be also configured to receive information from an external device such as a computing device able to, for example, update information related to the users wearing the wearable device in which the transmitting module is integrated. The external device may be any computing device able to, for example, updating information related to the user wearing the wearable device. The transmitting device may further comprise a first processing unit configured to generate the signal representing the identification code data associated to the user, and to manage the first storage unit, the encoding unit and the first transceiver. The encoding unit may be, for example, a LC circuit modulated by the first processing unit.

In some examples, the receiving module may be internally coupled to the grip adapter of the weapon, for example the grip adapter of a firearm. As used herein, grip adapter may refer to the side-coverings of the weapon's handle. In some examples the grip adapters may be configured to substantially cover the weapon's handle while in some other examples the grip adapters may substantially extend over the weapon's handle, e.g. the grip adapters may extend from the weapon's handle to the weapon's barrel. As used herein, the gripping portion or gripping area may refer to the portion of the grip adapter that is to be occupied by the user's hand, behind the trigger guard, when the weapon is being gripped by said user.

In some examples, the receiving module may comprise a third electrode that is attached to the gripping portion of the grip adapter, i.e., to the portion of the grip adapter configured to allow the user to grip the weapon. Since the grip adapter is made of an insulating material, such as plastic, the third electrode is electrically insulated from the frame of the weapon and, in principle, from the user's body. The receiving module also comprises a fourth electrode that may be coupled to the grip adapter and may be in direct contact to the frame of the weapon. Thus, the fourth electrode may be electrically coupled to the user's body via the frame of the weapon that may be made of metal. The third electrode and the fourth electrode may be electrically insulated from each other. The receiving module may further comprise a receiving device configured to receive the signal generated by the transmitting module via the third and fourth electrodes, decode the received signal and actuate on the safety system of the weapon based on the received signal.

In such examples, the receiving device may comprise a second transceiver configured to receive the encoded signal via the signal path from the transmitting module and to send to the transmitting module data such as the number of shots fired by the weapon, the presence/absence of a round in the chamber, the temperature of the barrel, the number of rounds in the magazine, the state of safety system (blocked/unblocked), etc. The second transceiver may be further configured to receive information from any other external device such as a computing device able to, for example, updating information related to the users with permission to use the weapon. The receiving device may also comprise a second storage unit configured to store at least access code data associated to users having authorization to use the weapon, a decoding unit configured to decode the encoded signal and a second processing unit configured to manage the second storage unit, the decoding unit and the second transceiver. The second processing unit may be further configured to compare the identification code data of the decoded signal to the access code data and allow the user the usage of the weapon based on the result of the comparison.

Thus, the second processing unit is configured to compare the received identification code data that corresponds to the user wearing the wearable device in which the transmitting module is integrated, to the list of access code data stored in the receiving module. The access code data may be a list of identification code data corresponding to users having permission for using the weapon. When the received identification code data is identical to any of the identification code data of the access code data, the second processing unit may actuate on a locking mechanism (e.g., a mechanical actuation pin locking the trigger of the firearm) to unlock the weapon. As a result, the authorized person can fire the weapon, that is locked by default, as normal. However, when the receiving module does not receive any signal or it receives a signal corresponding to an unauthorized user, i.e. the identification code data received does not match the access code data stored in the weapon, the locking mechanism is not disabled, so the trigger of the weapon remains locked and will not fire.

In some examples, the transmitting module and the receiving module may have a master-slave configuration such that one single transmitting module (master) may be associated to one single receiving module (slave) and the user wearing the wearable device (e.g. the shoe) that integrates the transmitting module may be the only user authorized to use the weapon that integrates the receiving module. In other examples, the transmitting module (master) may be associated to several receiving modules (slaves) such that the user wearing the shoe that integrates the transmitting module may be the only user authorized to use the weapons that integrate the several receiving modules. In other examples, several transmitting modules (slaves) may be associated to one single receiving module (master) such that the several users wearing the several shoes that integrate the transmitting modules may be the users authorized to use the one single weapon that integrates the receiving module.

In some examples, the third electrode may extend from the gripping portion of the grip adapter to a barrel of the weapon. The third electrode may be attached to the inner surface of any of the two grip adapters that extend from the gripping area to the barrel area of the weapon. The grip adapters may be made of an electric insulating material, such as plastic material. The third electrode is, in principle, electrically insulated from the user's body, but at least part of the third electrode in the barrel area may extend until the external surface of the barrel of the weapon such that when the user touches that part of the barrel, the user's hand is in electric contact to the third electrode. Thus, when the authorized user holds the weapon with one hand (that is in contact with the fourth electrode via the frame of the weapon) and places the other hand in the barrel of the weapon (making direct contact with the third electrode), the weapon will be blocked because the two electrodes will be in contact with the user's body. This can be very useful in cases where the authorized user has a struggle with another person.

In some examples, the authorization management system comprises a grip detector configured to initialize at least one of the receiving module and the transmitting module in response to detection of the user of the weapon. The grip detector may be integrated into the gripping area of the weapon and may comprise, for example, pressure sensors, capacitive detectors, switches, such that when the presence of a hand gripping the gripping area of the weapon is detected, the grip detector may send an activation signal to at least one of the receiving module and the transmitting module. By implementing a grip detector energy is saved so the life of the authorization management system may be extended.

The present disclosure provides a wearable device comprising a transmitting module. The transmitting module further comprises a first electrode electrically coupled to the body of a user. The first electrode may be configured to capacitively couple a signal representing at least an identification code data associated to a user via a signal path through the user's body. The transmitting module further comprises a second electrode electrically insulated from the user's body and located in proximity to the ground. This second electrode is a reference electrode and is electrically insulated from the first electrode. The transmitting module also comprises a transmitting device located below the user's calf and being configured to generate the signal and transmit the signal via the first electrode to a receiving module. The transmitted signal, once received at the receiving module, may cause the receiving module to actuate on a safety system of the weapon for allowing the user using the weapon.

In some examples, the transmitting device may comprise a storage module to store at least the identification code data associated to the user, a transceiver to transmit the encoded signal via the first electrode and a processing unit configured to generate the signal and manage the storage unit, the encoding unit and the transceiver. The storage module may further store data received from the receiving module such as the number of shots fired by the weapon, the presence/absence of a round in the chamber, the temperature of the barrel, the number of rounds in the magazine, the state of safety system (blocked/unblocked), etc In some examples, the transmitting device is located in a heel of a footwear, the first electrode is located within the footwear and in electric contact to the user's body and the second electrode is coupled to an insole of the footwear.

The present disclosure provides a weapon comprising a receiving module. The receiving module may comprise a first electrode coupled to a grip adapter of the weapon and being electrically insulated from a frame of the weapon and a second electrode coupled to the grip adapter, and more particularly to a griping area of the grip adapter, and electrically coupled to the frame of the weapon. The second electrode is electrically coupled to the user's body via the frame and is electrically insulated from the first electrode. The receiving module also comprises a receiving device configured to receive a signal via the first and second electrodes and a signal path including a body of a user. The signal may be received from a transmitting module coupled to a wearable device worn by the user of the weapon. The transmitting module may be located at least partially in proximity to the ground and the signal may represent at least an identification code data associated to the user. The receiving module may be further configured to actuate a safety system of the weapon for allowing the user a usage of the firearm based on the received signal.

In some examples, the receiving device may comprise a transceiver configured to receive the signal, a storage unit configured to store at least access code data associated to users having authorization to use the weapon and a processing unit configured to manage the storage unit and the transceiver. This processing unit may be also configured to compare the identification code data of the signal to the access code data and allow the user the usage of the weapon based on the result of the comparison.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

BRIEF DESCRIPTION OF THE DRAWINGS

To complete the description and in order to provide a better understanding of the disclosure, a set of drawings is provided. Said drawings form an integral part of the description and illustrate embodiments of the disclosure, which should not be interpreted as restricting the scope of the disclosure, but just as an example of how the disclosure can be carried out. The drawings comprise the following figures.

DETAILED DESCRIPTION OF THE DRAWINGS

Figure 1:
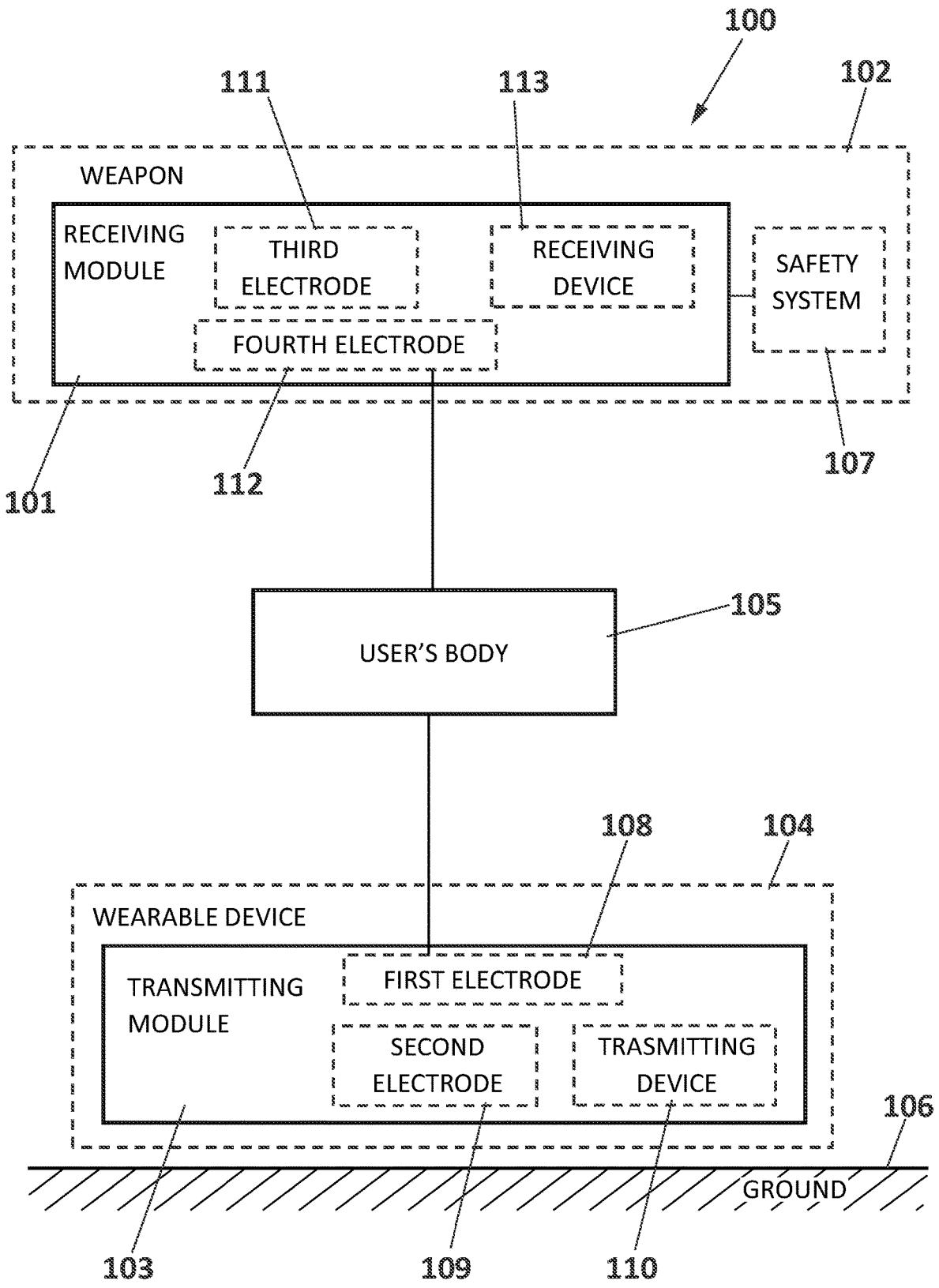
FIG. 1 shows a block diagram of an example authorization management system for personal use of weapons.

Referring to FIG. 1, there is illustrated a block diagram of an example authorization management system 100 for personal use of weapons, e.g. firearms. It should be understood that the authorization management system 100 depicted in FIG. 1 may include additional components and that some of the components described herein may be removed and/or modified without departing from a scope of the authorization management system 100.

The authorization management system 100 comprises a receiving module 101 attached to a weapon 102 and a transmitting module 103 coupled to a wearable device 104. The wearable device 104, e.g. a shoe, is configured to be worn by a user in proximity to the own body 105 and to be located in proximity to the ground 106. The transmitting module 103 is configured to capacitively transmit a signal representing at least an identification code data associated to the user via a signal path through a user's body 105. The receiving module 101 is configured to receive the signal and actuate a safety system 107 of the weapon 102 for allowing the user a usage of the weapon 102 based on the received signal.

The transmitting module 103 comprises a first electrode 108 electrically coupled to the user's body 105. The first electrode 108 may be configured to capacitively couple the signal to the user's body 105 via the signal path. The transmitting module 103 also comprises a second electrode 109 electrically insulated from the user's body 105. The second electrode 109, that is the reference electrode of the transmitting module 103, may be located substantially parallel to the ground. This second electrode 109 is also electrically insulated from the first electrode 108. The transmitting module 103 also comprises a transmitting device 110, preferably located below a calf of the user's body 105, that is configured to generate the signal and transmit the signal via the first electrode 108.

In turn, the receiving module 101 comprises a third electrode 111 attached to the grip adapter of the weapon 102. This third electrode 111 is electrically insulated from the frame (not shown) of the weapon 102 and from the user's body 105. The receiving module 101 also comprises a fourth electrode 112 that is attached to the to the grip adapter, and more particularly to the gripping portion of the grip adapter (not shown), and to the frame of the weapon 102. Since the frame is made of a metal material, the fourth electrode 112 is electrically coupled to the user's body 105 via the frame. The third electrode 111 and the fourth electrode 112 are electrically insulated from each other. The receiving module 101 further comprises a receiving device 113 configured to receive the signal generated by the transmitting module 103 via the third electrode 111 and fourth electrode 112, decode the received signal and actuate on the safety system 107 of the weapon 102 based on the received signal. The fourth electrode 112 is electrically coupled to the user's hand via the frame when the weapon 102 is gripped by the user while the third electrode 111 remains electrically insulated.

The electronics of the receiving module 101 and of the transmitting module 103 may be mounted on respective Systems on Chips (SoCs) attached to corresponding Printed Circuit Boards (PCBs).

Figure 2:
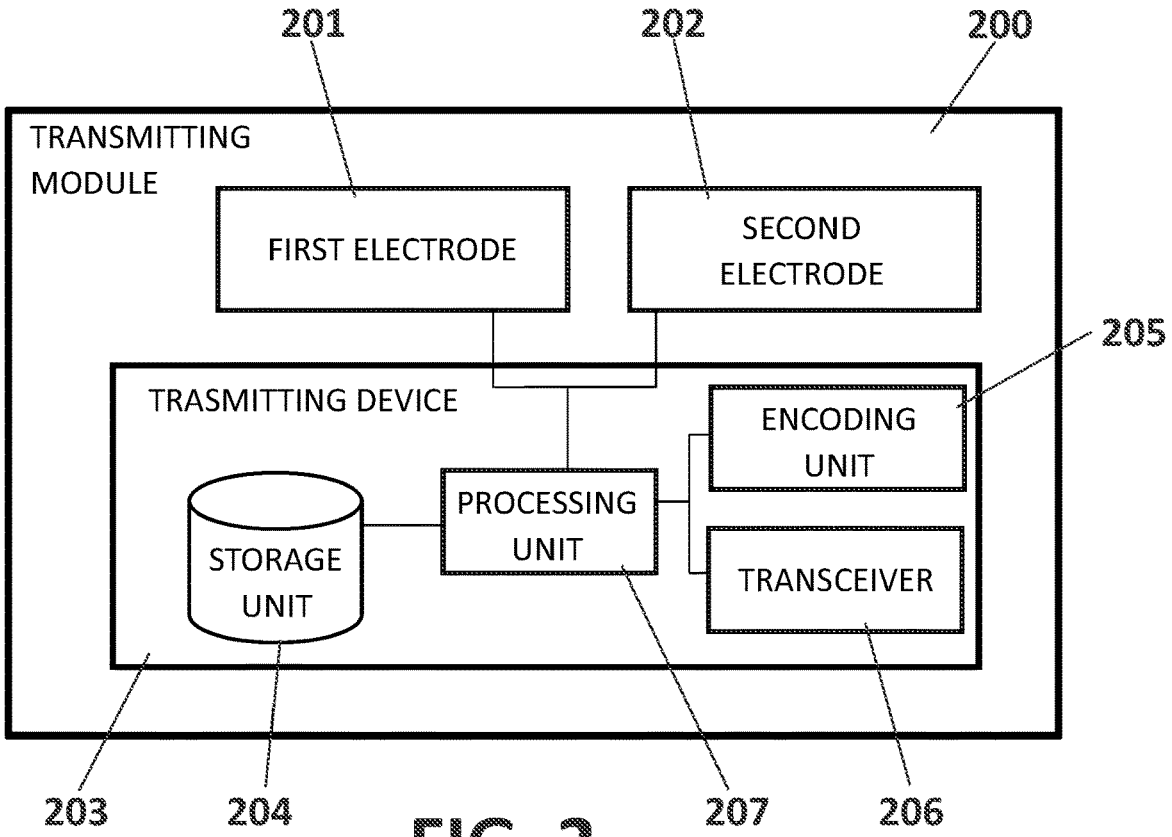
FIG. 2 shows a block diagram of an example transmitting module attachable to a wearable device.

FIG. 2 shows a block diagram of an example transmitting module 200 attachable to a wearable device. It should be understood that the transmitting module 200 depicted in FIG. 2 may include additional components and that some of the components described herein may be removed and/or modified without departing from a scope of the transmitting module 200.

The transmitting module 200 may be attached to a wearable device (not shown in this figure) preferably located in proximity to the ground. For example, the transmitting module 200 may be attached to a footwear. The transmitting module 200 comprises a first electrode 201 electrically coupled to the user's body. For example, the first electrode may be in a footwear in direct contact with the user's body or in indirect contact by interposition of an electrically conductive element such as a socket. The first electrode 201 is configured to capacitively couple the signal to the user's body via a signal path. The transmitting module 200 further comprises a second electrode 202 electrically insulated from the user's body. This second electrode 202, that is electrically insulated from the first electrode 201 and that is configured to act as a reference electrode, is preferably located substantially parallel to the ground. In addition, the transmitting module 200 comprises a transmitting device 203 located below a calf of the user, for example in a footwear, and being configured to generate the signal and transmit the signal via the first electrode 201.

In turn, the transmitting device 203 comprises a first storage unit 204 configured to store the identification code data that unequivocally identify a particular user. The transmitting device 203 further comprises an encoding unit 205 to encode the signal by modulating an electric field that capacitively couples to the user's body and a first transceiver 206 to transmit the encoded signal via the first electrode 201. The first transceiver 206 may be also used for receiving information from the receiving module (not shown in this figure) or from any other external device (not shown in this figure). The external device may be any computing device able to, for example, updating information related to the user wearing the wearable device. In some examples, the first transceiver 206 may implement a WiFi subsystem or a GPRS subsystem to communicate to the external device. The transmitting device 203 may further comprise a first processing unit 207 configured to generate the signal representing the identification code data associated to the user, and to manage the first storage unit 204, the encoding unit 205 and the first transceiver 206.

In some examples, the transmitting device 203, and more particularly the transceiver 206, can operate at 330 kilohertz. This frequency provides the best propagation on the user's skin.

Figure 3:
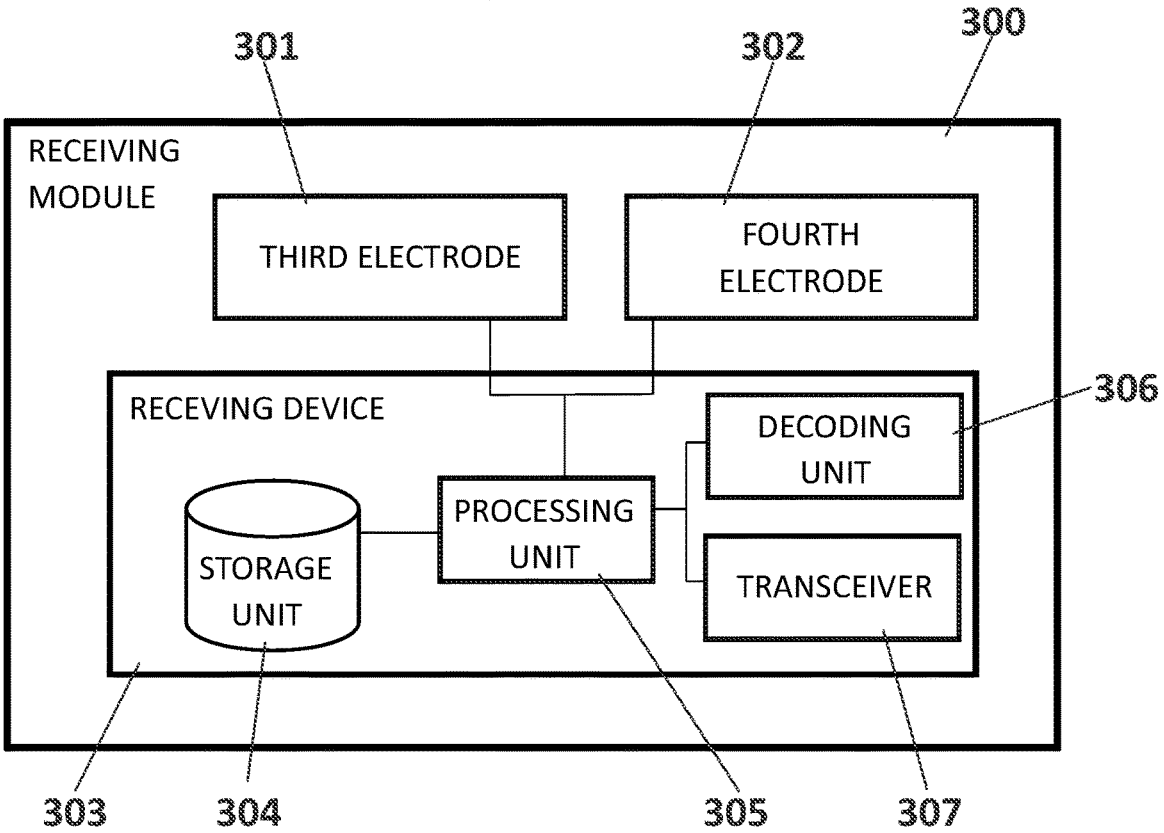
FIG. 3 shows block diagram of an example receiving module to be attached to a weapon.

FIG. 3 shows a block diagram of an example receiving module 300 attachable to a wearable device. It should be understood that the receiving module 300 depicted in FIG. 3 may include additional components and that some of the components described herein may be removed and/or modified without departing from a scope of the receiving module 300.

The receiving module 300 has a third electrode 301 attached to the grip adapter of the weapon (not shown in this figure) and electrically insulated from the frame of the weapon and from the user's body. The receiving module 300 also has a fourth electrode 302 that is electrically insulated from the third electrode 301 and that is attached to the grip adapter and to the frame of the weapon. The fourth electrode 302 is in electric contact with the user's body via the frame when the user grips the weapon. The receiving module 300 further comprises a receiving device 303 configured to receive the signal generated by the transmitting module (not shown in this figure) via the third electrode 301 and the fourth electrode 302, decode the received signal and actuate on the safety system of the weapon based on the received signal.

In turn, the receiving device 303 may comprise a second transceiver 307 configured to receive the encoded signal via the signal path from the transmitting module and to send other data to the transmitting module such as the number of shots fired by the weapon, the presence/absence of a round in the chamber, the temperature of the barrel, the number of rounds in the magazine, the state of safety system (blocked/unblocked), etc. The second transceiver 307 may be further configured to receive information from any other external device such as a computing device able to, for example, updating information related to the users with permission to use the weapon. The receiving device 303 comprises a second storage unit 304 configured to store the access code data associated to users having authorization to use the weapon, for example a list of identification code data associated to users having permission to use the weapon. The access code data can be updated by means of the second transceiver. In some examples, the second transceiver 307 may implement a WiFi subsystem or a GPRS subsystem to communication to the external device. The receiving device 303 also comprises a decoding unit 306 configured to decode the encoded signal and a second processing unit 305 configured to manage the second storage unit 304, the decoding unit 306 and the second transceiver 307.

The second processing unit 305 is further configured to compare the identification code data of the decoded signal to the access code data and allow the user the usage of the weapon based on the result of the comparison. Thus, the second processing unit 305 compares the received identification code data that corresponds to the user wearing the wearable device in which the transmitting module (not shown in this figure) is integrated, to the access code data stored in the second storage unit 304. For example, the second processing unit 305 compares the received identification code data to the list of identification code data of the access code data that corresponds to the users having permission for using the weapon. When the received identification code data is identical to any of the identification code data of the access code data, the second processing unit 305 may actuate on a locking mechanism (e.g., a mechanical actuation pin locking the trigger or the firing pin of the weapon, a mechanical pin for blocking the gun safety, etc.) of the safety system to unlock the firearm. As a result, the weapon that is locked by default becomes unlocked so the authorized person can fire the firearm. The receiving module 300 periodically (at a pre-defined time period) checks the received signal such that the weapon remains unlocked as long as the proper identification code data is received from the transmitting module.

However, when the receiving device 303 does not receive any signal or it receives a signal corresponding to an unauthorized user, i.e. the received identification code data does not match the access code data stored in the second storage unit 304, the locking mechanism of the safety system is not disabled, so the trigger of the firearm remains locked and will not fire.

The data stored in the first storage unit and the second storage unit can be accessed by respective controllers (not shown in FIGS. 2 and 3). The first storage unit and its corresponding controller may form a transmitter-side chip while the second storage unit and its corresponding controller may form a receiving-side chip. The first storage unit and the second storage unit may be any electronic, magnetic, optical, or other physical storage apparatus to contain or store information. For example, the first storage unit and the second storage unit may be any of Random-Access Memory (RAM), volatile memory, non-volatile memory, flash memory, a storage drive (e.g., a hard drive), a solid-state drive, and the like, or a combination thereof.

The first and second processing units may be any of a central processing unit (CPU), a semiconductor-based microprocessor, a graphics processing unit (GPU), a field-programmable gate array (FPGA) configured to retrieve and execute instructions, other electronic circuitry suitable for the retrieval and execution instructions stored on a machine-readable storage medium storing the functionalities of the first and second processing units, or a combination thereof.

Having two electrodes electrically insulated from each other in the transmitting module and the receiving module, respectively, generates a potential difference between each pair of electrodes that allows measuring a voltage.

Figure 4:
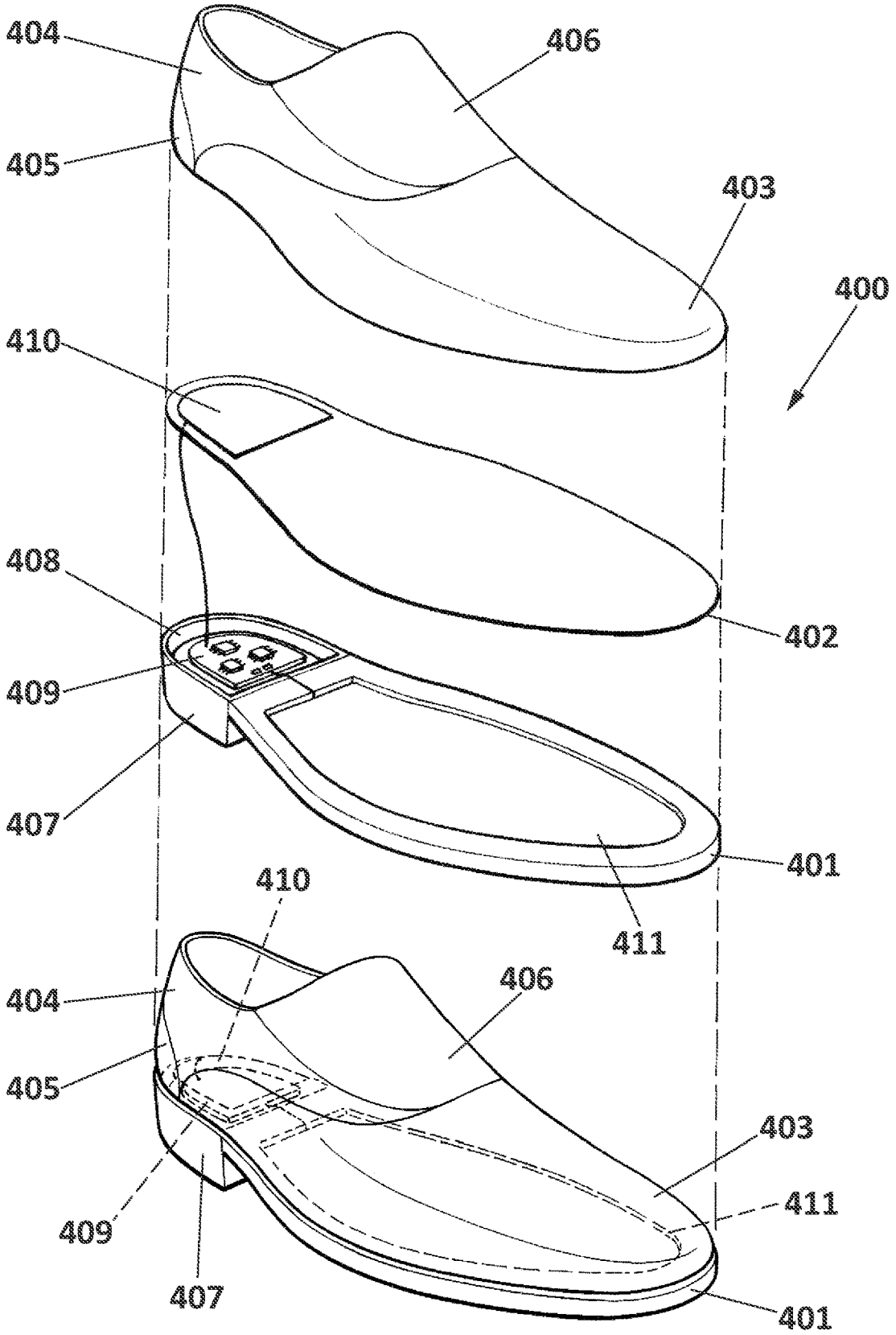
FIG. 4 shows an exploded view of an example footwear integrating the transmitting module.

FIG. 4 shows an exploded view of an example footwear 400 integrating the transmitting module. It should be understood that the footwear 400 depicted in FIG. 4 may include additional components and that some of the components described herein may be removed and/or modified without departing from a scope of the footwear 400.

The footwear is a shoe 400 having an outsole 401, a midsole 402, a toe cap 403, a quarter 404, a counter 405, a throat 406 and a heel 407. The heel 407 integrates the electronics of the transmitting device. In particular, the heel 407 has a housing 408 to house a PCB 409 where the first storage unit, the first processing unit, the encoding unit and the first transceiver are attached thereto. The PCB 409, and more particularly the first processing unit, is electrically wired to the first electrode 410 and to the second electrode 411. The first electrode 410 is attached to the midsole 402 in correspondence to the heel 407 of the shoe 400. In some examples the midsole 402 may integrate the insole of the shoe 400 and the first electrode 410 may be attached to the upper surface of the insole to be in a more direct contact to the user's body. In some other examples, the insole (not shown in this figure) may be an independent element located on the upper surface of the midsole 402 and may be, at least partially, made of a conductive material to facilitate transmission of the signal from the first electrode 410 to the user's body. In some examples, the user may be wearing a sock with silver threads, at least in the part of the sock in contact to the first electrode 410, in order to improve the transmission of the signal between the first electrode 410 and the user's body.

The second electrode 411, that is the reference electrode, is attached to the upper surface of the outsole 401. The second electrode 411 may have a size that substantially corresponds to the size of outsole 401 and may be made of stainless steel. In such example, the first electrode 410 and the second electrode 411 are respective metal foils attached to the corresponding midsole 402 and outsole 401 by, for example, conductive paint. The second electrode 411 is electrically isolated from the first electrode 410 and from the user's body by the midsole 402 that is made of, for example, leather or plastic.

All electrical and electronic devices of the transmitting module may be powered by a DC voltage source such as storage batteries or the like (not shown). For example, the transmitting module may integrate a battery in the heel 407 to feed the electrodes 410, 411 and the transmitting device. The battery may be charged by inductive charging means or may have a USB port accessible from the inside of the shoe 400. The inductive charging means receive energy by an electromagnetic field generated by an external inductive charging station. This energy is sent through an inductive coupling to an electrical device, for example a coil, in the transmitting device which can then use that energy to charge batteries (not shown in the figure) located in the heel or to directly run the transmitting module.

The metal electrodes in the footwear have a large area (the larger the better), which allows good conduction through the user's skin. Therefore, the electrical current used to transmit the signal generated is fed into the user's body which acts as a "wet wire". This electrical current is small in intensity and does not damage to the health of the user.

In some other examples, the first and second electrodes 410, 411 may be located in other different positions within the footwear. The second electrode 411 will be preferably located in parallel to the ground to maximize the magnitude of the signal capacitively coupled to the user's body via the first electrode.

Figure 5:
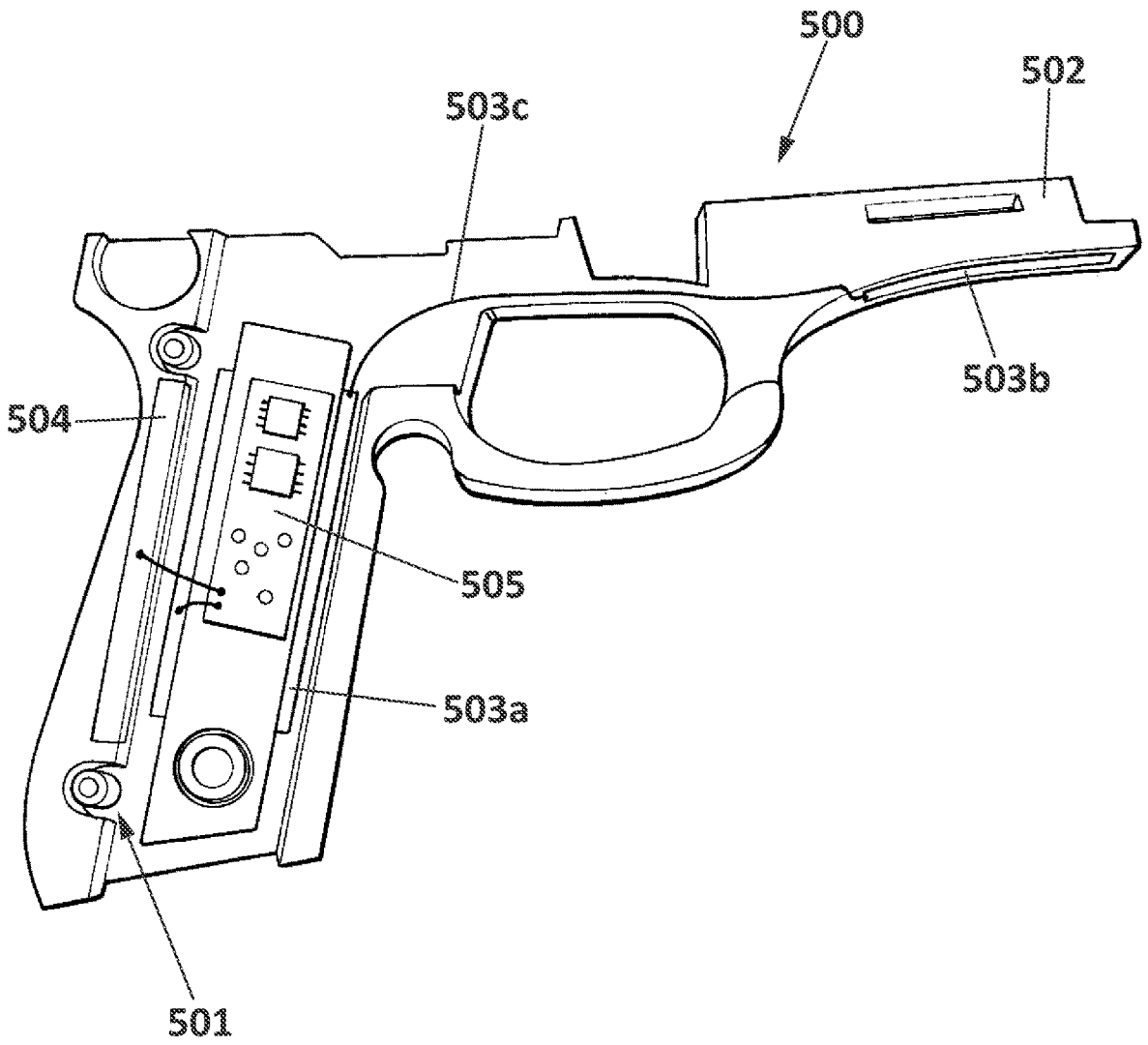
FIG. 5 shows a cross sectional view of an example grip adapter of a firearm integrating the receiving module.

FIG. 5 shows a cross sectional view of an example grip adapter 500 of a firearm integrating the receiving module. It should be understood that the grip adapter 500 of the firearm depicted in FIG. 5 may include additional components and that some of the components described herein may be removed and/or modified without departing from a scope of the grip adapter 500 of the firearm.

The grip adapter 500 extends from the gripping area 501 of the gun to the barrel area 502 of the gun. The grip adapter 500 is made of an electrical insulating material such as plastic, wood, ceramic or any other insulating material.

The third electrode 503 also extends from the gripping area 501 of the grip adapter 500 to the barrel area 502 of the grip adapter 500. In particular, the third electrode 503 is formed by a first portion 503*a* attached to the inner surface of the gripping area 501 of the grip adapter 500 and a second portion 503*b* attached to the barrel area 502 of the grip adapter 500. The first portion 503*a* and the second portion 503*b* of the third electrode 503 are electrically coupled to each other by a wire 503*c*. The second portion 503*b* extends to the outer surface of the barrel of the gun (when the grip adapter is mounted to the frame of the gun) such that, although the third electrode 503 is electrically insulated from the user's body when the user grips the gun by the handle (the third electrode 503 is, in principle, in contact to only the insulating material of the grip adapter 500), the third electrode 503 may be in contact with the user's body when the user surrounds the barrel with the hand and directly contacts the second portion 503*b* of the third electrode 503.

The fourth electrode 504 is attached to the grip adapter 500 and is electrically coupled to the frame (not shown in this figure) of the gun. The grip adapter 500 is attached to the frame by screws. Since the frame is made of metal, the fourth electrode 504 is electrically coupled to the user's body when the user grips the gun.

While in FIG. 5 the fourth electrode 504 is formed by one sheet of metal, it may be formed by several interconnected sheets of metal to improve the behaviour of the receiving module.

Since the fourth electrode 504 is in electric contact with the frame of the gun, and thus with the user's body, and the second portion 503*b* is also in electric contact with the user's body when the authorized user holds the weapon with one hand (that is in contact with the fourth electrode 504) and places the other hand in the barrel area 502 of the weapon (that is in contact with the third electrode), the weapon will be blocked because the two electrodes will be in contact with the user's body. This can be very useful in cases where the authorized user has a struggle with another person.

The receiving module also comprises a PCB 505 integrating all the electronics of the receiving device. In particular, the PCB 505 has the second transceiver that receives the encoded signal from the transmitting module and sends other data to the transmitting module such as the number of shots fired by the weapon, the state of safety system (blocked/unblocked), etc. The second transceiver also receives information from external devices such as a computing device able to update the information related to the users with permission to use the gun. The PCB 505 also integrates the second storage unit that stores the access code data associated to users having authorization to use the gun, the decoding unit to decode the encoded signal and a second processing unit that is to manage the second storage unit, the decoding unit and the second transceiver.

The decoding unit may be a combination of a set of cascade amplifiers and regeneration amplifiers.

The PCB 505 is located on the gripping area 501 of the gun and on the first portion 503*a* of the third electrode 503. Both electrodes 503, 504 are connected to different points on the PCB 505 and may be attached to the grip 500 with conductive paint to improve the conductivity of the electrodes.

Authorization management systems as described herein allow authorized users to use the weapon with both hands, regardless of where the transmitting module is being worn by the user and without having to increase the power transmission of the size of the electrodes of the transmitting module or the receiving module. Besides, this authorization management system allows authorized users to use the weapon when the shooter wears gloves, in the presence of inhibitors, regardless of the type of floor, and even when the shooter is not in direct contact to the floor, for example when the shooter is on a table, platform or the like.

In this text, the term "comprises" and its derivations (such as "comprising", etc.) should not be understood in an excluding sense, that is, these terms should not be interpreted as excluding the possibility that what is described and defined may include further elements.

The disclosure is obviously not limited to the specific embodiments described herein, but also encompasses any variations that may be considered by any person skilled in the art within the general scope of the disclosure as defined in the claims.

The invention claimed is:

1. An authorization management system for personal use of a firearm, comprising:

a receiving module coupled to the firearm; and a transmitting module configured to be worn by a user in proximity to a body of the user and located in proximity to the ground;

wherein the transmitting module is configured to capacitively transmit a signal representing at least an identification code data associated to the user via a signal path through the user's body;

wherein the receiving module is configured to receive the signal and actuate a safety system of the firearm for allowing the user a usage of the firearm based on the received signal; and wherein the transmitting module comprises:

a first electrode electrically coupled to the user's body and being configured to capacitively couple the signal to the user's body via the signal path;

a second electrode located substantially parallel to the ground, the second electrode being a reference electrode and being electrically insulated from the first electrode; and a transmitting device located below a calf of the user and being configured to generate the signal and transmit the signal via the first electrode;

wherein the receiving module is internally coupled to a grip adapter of the firearm;

wherein the receiving module comprises:

a third electrode attached to the grip adapter and being electrically insulated from a frame of the firearm;

a fourth electrode coupled to the grip adapter, being electrically coupled to the frame and being electrically insulated from the third electrode; and a receiving device configured to receive the signal via the third and fourth electrodes, decode the received signal and actuate on the safety system of the firearm based on the received signal; and wherein the third electrode extends from a gripping area to a barrel area of the firearm.

2. The authorization management system according to claim 1, wherein the transmitting device is located in a heel of a footwear and the first electrode is within the footwear and in electric contact with the user's body.

3. The authorization management system according to claim 1, wherein the second electrode is coupled to an insole of a footwear.

4. The authorization management system according to claim 1, wherein the transmitting device comprises:

a first storage unit configured to store at least the identification code data associated to the user;

an encoding unit to encode the signal by modulating an electric field that capacitively couples to the user's body;

a first transceiver to transmit the encoded signal via the first electrode; and a first processing unit configured to manage the first storage unit, the encoding unit and the first transceiver.

5. The authorization management system according to claim 4, wherein the receiving device comprises:

a second transceiver configured to receive the encoded signal via the signal path;

a second storage unit configured to store at least access code data associated to users having authorization to use the firearm;

a decoding unit configured to decode the encoded signal;

a second processing unit configured to manage the second storage unit, the decoding unit and the second transceiver, wherein the second processing unit is further configured to compare the identification code data of the decoded signal to the access code data and allow the user the usage of the firearm based on the result of the comparison.

6. The authorization management system according to claim 5, wherein the second transceiver is configured to receive the encoded signal via the signal path from the transmitting module, to send data related to the firearm to the transmitting module and to receive information from an external device.

7. The authorization management system according to claim 4, wherein the first transceiver is configured to receive information from the receiving module or from any other external device.

8. The authorization management system according to claim 1, comprising a grip detector configured to initialize at least one of the receiving module and the transmitting module in response to detection of the user of the firearm.

9. A firearm comprising a receiving module, the receiving module comprising:

a third electrode coupled to a grip adapter of the firearm and being electrically insulated from a frame of the firearm;

a fourth electrode coupled to the grip adapter and being electrically coupled to the frame and electrically insulated from the third electrode; and a receiving device configured to receive a signal via the third and fourth electrodes and a signal path including a body of a user, the signal being received from a transmitting module coupled to a wearable device worn by the user of the firearm, and the signal representing at least an identification code data associated to the user, and the receiving module being further configured to actuate a safety system of the firearm for allowing the user a usage of the firearm based on the received signal;

wherein the wearable device comprises a transmitting module, the transmitting module comprising:

a first electrode electrically coupled to a user's body and being configured to capacitively couple a signal representing at least an identification code data associated to a user via a signal path through the user's body;

a second electrode electrically insulated from the user's body and located substantially parallel and in proximity to the ground, the second electrode being a reference electrode and being electrically insulated from the first electrode; and a transmitting device located below the user's calf and being configured to generate the signal and transmit the signal via the first electrode to a receiving module, the signal to cause the receiving module to actuate on a safety system of the firearm for allowing the user of the firearm a usage of the firearm based on the received signal, wherein the transmitting module is located in proximity to the ground;

wherein the receiving device is internally coupled to a grip adapter of the firearm and wherein the third electrode extends from a gripping area to a barrel area of the firearm.

10. The firearm according to claim 9, wherein the receiving device comprises:

a transceiver configured to receive the signal;

a storage unit configured to at least store access code data associated to users having authorization to use the firearm;

a decoding unit configured to decode the signal; and a processing unit configured to manage the storage unit, the decoding unit and the transceiver, wherein the processing unit is further configured to compare the identification code data of the signal to the access code data and allow the user the usage of the firearm based on the result of the comparison.

11. The firearm according to claim 9, comprising a grip detector configured to initialize the receiving device in response to detection of the user of the firearm.

12. The firearm according to claim 10, comprising a locking mechanism, the locking mechanism being actuated by the processing unit to lock/unlock the firearm based on the result of the comparison.

* * * * *